US010343420B2

(12) United States Patent
Young et al.

(10) Patent No.: US 10,343,420 B2
(45) Date of Patent: Jul. 9, 2019

(54) MEDIA SHEET TRANSPORT APPARATUS AND METHOD

(71) Applicant: Delphax Technologies Inc., Minnetonka, MN (US)

(72) Inventors: Harry Young, Toronto (CA); Robert Stuart McCallum, Caledon (CA); Cornelius Vandenberg, Richmond Hill (CA)

(73) Assignee: Delphax Technologies Inc., Minnetonka, MN (US)

( * ) Notice: Subject to any disclaimer, the term of this patent is extended or adjusted under 35 U.S.C. 154(b) by 0 days.

(21) Appl. No.: 15/974,765

(22) Filed: May 9, 2018

(65) Prior Publication Data

US 2018/0326754 A1 Nov. 15, 2018

Related U.S. Application Data

(60) Provisional application No. 62/505,856, filed on May 13, 2017.

(51) Int. Cl.

| | |
|---|---|
| ***B41J 11/00*** | (2006.01) |
| ***B65H 5/00*** | (2006.01) |
| ***B65H 5/06*** | (2006.01) |

(52) U.S. Cl.

CPC ..... *B41J 11/0015* (2013.01); *B41J 11/007* (2013.01); *B65H 5/004* (2013.01); *B65H 5/066* (2013.01); *B65H 2301/44334* (2013.01); *B65H 2301/5321* (2013.01); *B65H 2301/5322* (2013.01)

(58) Field of Classification Search

CPC ..... B41J 11/007; B41J 11/0015; B65H 5/004; B65H 5/066

See application file for complete search history.

(56) References Cited

U.S. PATENT DOCUMENTS

| | | | |
|---|---|---|---|
| 2005/0128275 | A1 | 6/2005 | Uji et al. |
| 2011/0299890 | A1 | 12/2011 | Imanaka et al. |
| 2013/0201237 | A1 | 8/2013 | Thomson et al. |

FOREIGN PATENT DOCUMENTS

| | | | |
|---|---|---|---|
| JP | H10 101243 | A | 4/1998 |

OTHER PUBLICATIONS

Partial European Search Report—EP 18 18 5106.

*Primary Examiner* — Lamson D Nguyen
(74) *Attorney, Agent, or Firm* — Stuart L. Wilkinson

(57) ABSTRACT

A media sheet drive has a continuous belt of a dielectric material for transporting sheet media supported on the belt in a transport direction. A launch mechanism is used to launch a sheet medium onto a top surface of the belt. A charging circuit including a charging head is used to charge a top surface of the sheet medium and the belt as the sheet medium is launched. Charging acts to generate an electrostatic tacking force to tack the sheet medium to the belt. To prevent high electric field near the belt top surface which might otherwise affect the printing process, a neutralizing circuit is positioned downstream of the charging circuit to reduce electric field near the top of the belt by balancing charge at the top and bottom of the belt while keeping the sheet medium tacked to the belt.

9 Claims, 4 Drawing Sheets

MEDIA SHEET TRANSPORT APPARATUS AND METHOD

CROSS REFERENCE TO RELATED PATENTS

The present U.S. Utility Patent Application claims priority pursuant to 35 U.S.C. 119(e) from U.S. Provisional Patent Application Ser. No. 62/505,856, entitled "Media sheet transport apparatus and method" filed May 13, 2017.

FIELD OF THE INVENTION

This invention relates to a media sheet transport apparatus and method and has particular but not exclusive application to transporting paper sheets for inkjet printers.

DESCRIPTION OF RELATED ART

Problem-free paper transport arrangements for printers are difficult to achieve, especially for separate sheets. Problems that can arise with different types of sheet transport arrangement include paper jams, skewed or translationally displaced images, and lifting or curling of paper away from an underlying platen or belt forming part of the sheet feed arrangement. Many transport systems and methods are known for moving a sheet of paper from an input zone, through a print zone, to an output zone. Generally, such transport systems have a drive arrangement for moving the sheet forward through the zones and a holding means for temporarily holding the sheet to an element of the drive arrangement such as a belt or platen. Well-known sheet transport systems for printers include vacuum systems and roller nips.

A known vacuum system includes a belt to which paper sheets are fed in an orderly sequence at an input zone and from which printed sheets are taken at an output zone. The belt has perforations throughout its length and is driven over an opening to an adjacent air plenum in which a partial vacuum is maintained during the sheet feeding process. The vacuum acts through the perforated belt to suck the paper sheets against the belt. The belt is driven around a roller system to take the vacuum tacked paper sheet from the input zone, past the print zone, to the output zone.

A problem with many vacuum belt systems is that the partial vacuum in the plenum may develop air currents tending to flow around the edge of a transported sheet. The air currents may disturb adjacent air in the gap between the belt and the inkjet print head causing the ink passing across the gap between the print head and the paper to move away from its intended path. This results in the printed image being distorted. This may not be a serious problem where the printed sheet is to be subsequently trimmed to remove a margin region, such being the case, for example, with book printing. However, the problem is more serious in the case of printing checks and other transaction materials where, in order to prevent waste, it is desirable to print sheet materials with no margins, and where the time and equipment involved in an extra trimming step are undesirable.

Another problem with such belt vacuum systems arises from the usual manner of supporting the belt. Normally, the belt is driven over a series of idler rollers which act generally to support the belt throughout its length, but provide specific support immediately adjacent a print head so as to maintain the spacing between the transported sheet and the print head at a precisely desired distance. This means, in practice, that an idler roller must be mounted very close to an associated print head at each print zone. While this is advantageous in terms of a precisely maintained sheet to print head separation, it means that the suction applied to the transported paper sheet to keep it against the belt may be temporarily reduced where the belt passes over a roller. The reduced suction force can result in a region of the paper sheet lifting or curling at the associated print zone which, in turn, can detract from the printed image quality or cause paper jams.

Other systems for transporting sheet media to be printed have used roller nips, with a roller nip being formed by a pair of rollers mounted with parallel axes of rotation and with the roller surfaces bearing against one another and configured to nip a paper sheet between them as the rollers are rotated in opposite directions. Depending on the particular configuration of sheet transport system, a first roller pair forming a first nip may be mounted upstream of a print zone and be operable to deliver individual sheets to the print zone. Similarly, a second roller pair forming a second nip may be mounted downstream of the print zone and be operable to grip and pull a sheet through and out of the print zone after the sheet has been presented to the print head by the upstream nip. While this may be satisfactory for single print heads, it is problematic for multiple print heads intended to print combined layer images. Because rollers pairs are mounted upstream and downstream of each print zone, it means that in order to accommodate the rollers, the spacing between successive print heads is larger than is desirable. The greater spacing between adjacent print heads coupled with the particular mechanics of the roller nips give greater scope for a sheet of print medium to undergo unwanted movement in its transport between the adjacent print heads. Another problem with roller nips arises particularly in rapid print systems where sheets may be fed at a rate on the order of 700 mm per second. At this feed rate, with successive print heads used to print components of a composite image, there may not be enough time for ink of a first image to dry by the time the sheet is being grabbed by the roller nip to present it to the next print head for overprinting of a second image. If the ink is not dry, then there is a risk that the roller nip will smudge the first image.

U.S. Pat. No. 8,172,152 describes a printing apparatus having a series of inkjet print heads spaced from one another in a transport direction. A continuous belt of dielectric material is driven around a roller system to feed sheet media successively to the print heads. A sheet medium is caused to become electrostatically tacked to the belt by passing the sheet past a charging circuit which sets up charge separation between a top surface of the belt, including the sheet medium, and the bottom surface of the belt. One effect of the charging can be a high electric field near the print heads which, in certain circumstances, can adversely affect the motion of droplets leaving the inkjet print heads.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
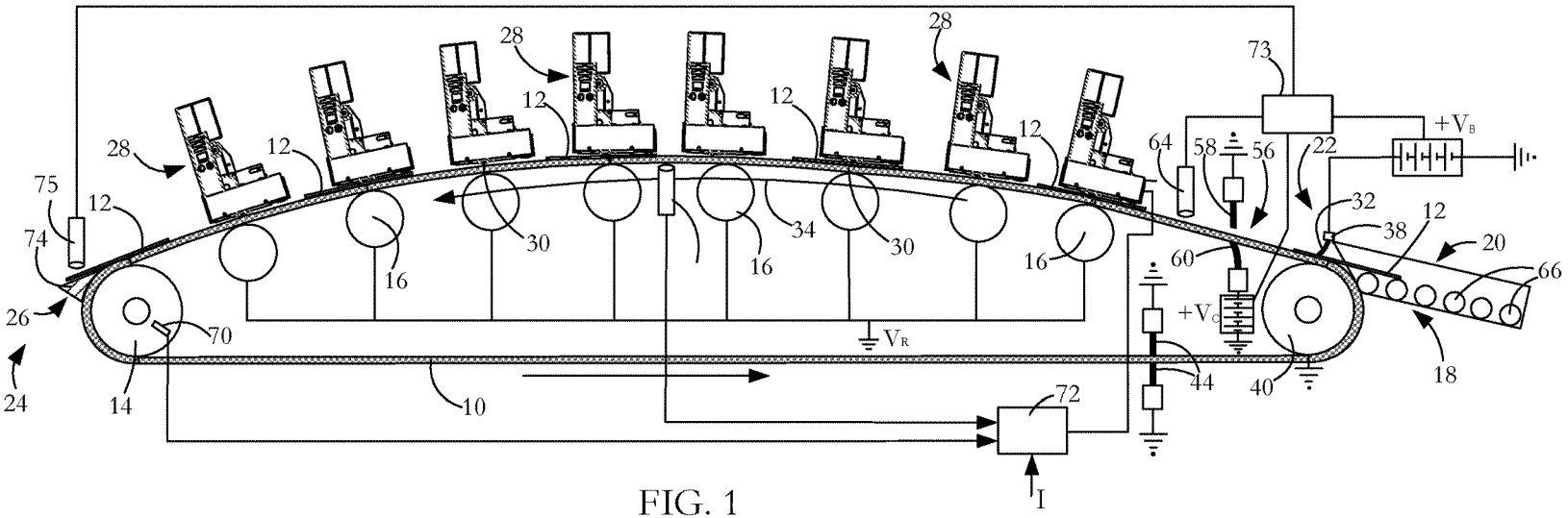
FIG. 1 is a side view of a paper sheet transport mechanism according to an embodiment of the invention.
Figure 2:
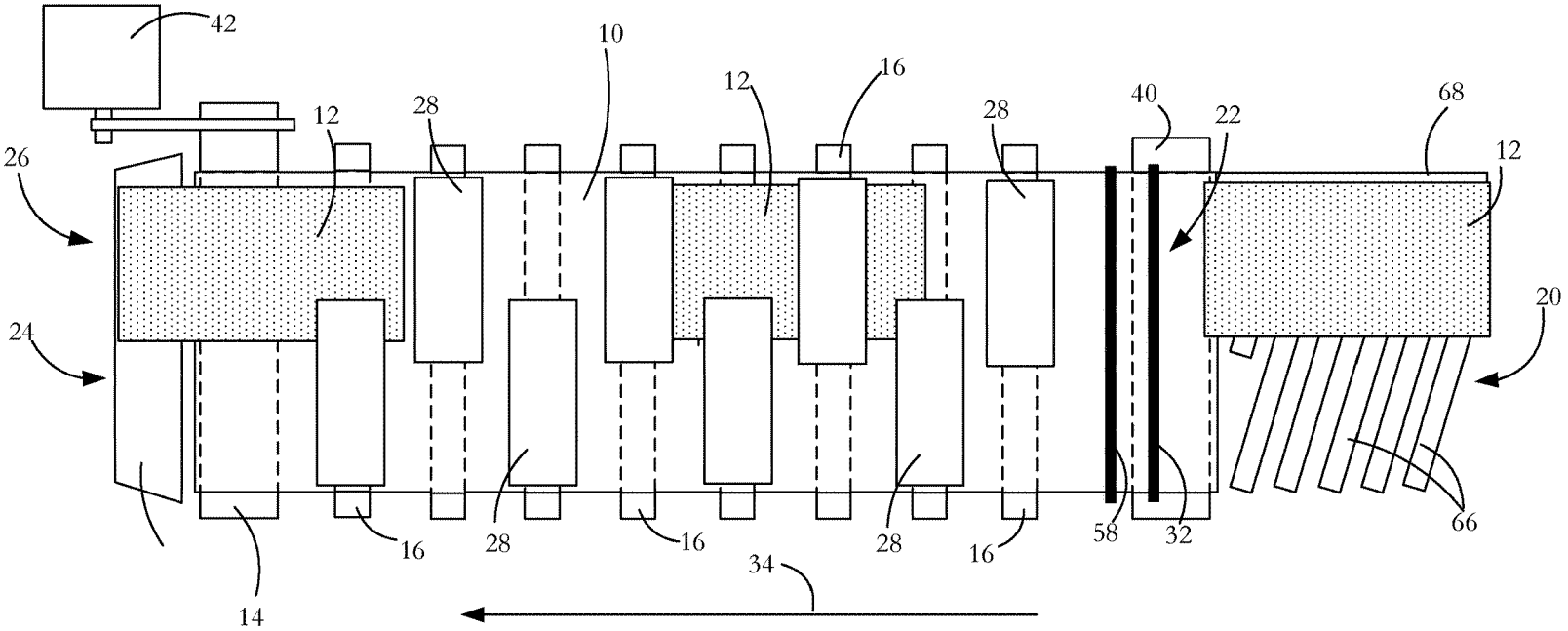
FIG. 2 is a top view of the arrangement of FIG. 1.

Referring in detail to FIG. 1, there is shown a continuous belt 10 for transporting paper sheets 12, the belt being driven by a drive roller 14 around a series of anodized idler rollers 16. At an input zone, shown generally as 18, there is a paper alignment sub-system 20 and a charge transfer sub-system 22. At an output zone shown generally as 24, is a paper sheet stripper arrangement 26. Each of the idler rollers 16 is located adjacent a corresponding inkjet print engine 28. Each print engine contains an inkjet print head 30 and mechanical, electrical and fluidic hardware needed to position and operate the print head. The belt 10 is made of Mylar®, an electrical insulator having a high dielectric strength, the belt having a thickness of the order of 0.13 millimeters. While other belt materials are envisioned, Mylar® is particularly suitable owing to its strength, stiffness, transparency, dielectric strength and low leakage. As shown in FIGS. 1 and 2, the inkjet print engine array comprises eight print engines arranged in two staggered banks of four print engines. As shown in the side view, the print engines of each bank are arranged in a wide diameter arc with each print engine 28 facing the belt 10 where the belt passes over an associated idler roller 16. The idler rollers are typically maintained at ground potential although negative or positive voltage $V_R$ can be applied to one of more of them. Such an applied voltage can supplement the effect of the neutralizing circuit to be described presently On the face of each print head 30 are nozzles having exit openings spaced from the upper surface of the belt by ½ to 1 millimeter. By tensioning the continuous belt 10 over the arcuate arrangement of rollers 16, the print head-to-belt spacing is maintained at a comparatively unvarying distance.

Inkjet printers operate by ejecting droplets of ink onto a web or sheet medium. Such printers have print heads that are non-contact heads with ink being transferred during the printing process as minute "flying" ink droplets over a short distance of the order of ½ to 1 millimeter. Modern inkjet printers are generally of the continuous type or the drop-on-demand type. In the continuous type, ink is pumped along conduits from ink reservoirs to nozzles. The ink is subjected to vibration to break the ink stream into droplets, with the droplets being charged so that they can be controllably deflected in an applied electric field. In a thermal drop-on-demand type, a small volume of ink is subjected to rapid heating to form a vapour bubble which expels a corresponding droplet of ink. In piezoelectric drop-on-demand printers, a voltage is applied to change the shape of a piezoelectric material and so generate a pressure pulse in the ink and force a droplet from the nozzle. Of particular interest in the context of the present invention are thermal drop-on-demand inkjet print heads such as those commercially available from Silverbrook Research. These print heads are sold under the Memjet trade name and have a very high nozzle density, page wide array and of the order of five channels per print head. Such inkjet print heads have a very high resolution of the order of 1600 dots per inch.

The charging subsystem includes a brush 32 extending transverse to the feed direction 34. The brush 32 has a series of conducting bristles 36 which are fixed at their upper ends into a conducting housing 38 and which have their lower ends in contact with or close to the upper surface of a paper sheet 12 as it is launched onto the belt 10 at the input zone 18. If the bristles 36 contact paper sheets at the sheet input zone, contact pressure is kept sufficiently low that the sheets are neither damaged nor displaced by the contact. The brush is located close to a grounded conductive roller 40 underlying the belt 10.

An alternative charging subsystem is described in copending U.S. patent application Ser. No. 15/594,566 the disclosure of which application is hereby incorporated by specific reference. This charging subsystem has a metal charging roller which has a secondary function to smooth out curled edges of paper or other transported media as they are acted on by the charging circuit so that the full area of a launched sheet medium is made subject to the electrostatic tacking force. To minimize damaging contact with sheet media, the roller may be made "soft". In one example, the roller is made of a metal mesh constructed to offer some degree of resilience or elasticity. In a further example, a resilient sleeve surrounds the roller, the sleeve made sufficiently thin that for the material composition of the sleeve it does not severely adversely affect the charging function of the metal roller. In yet another example, the roller is made of a highly conductive foam rubber material.

In operation, the belt 10 is driven by the drive roller 14 from a motor 42. The belt 10 tracks around the idler rollers 16 and the roller 40. A potential $V_B$ in the range 1 kV to 3.5 kV is applied to the charging brush or roller 32. As a paper sheet 12 is transported by the belt 10 past the brush 32, charge is transferred from the tips of bristles 36 to the sheet 12. The sheet 12 is charged positive and a corresponding negative charge develops on the underside of the belt owing to the presence of the grounded roller 40. The charging process causes the launched charged paper sheets 12 to become electrostatically "tacked" to the belt 10. The highly dielectric nature of the material of the Mylar belt means that charge on the paper sheets does not leak away as the sheets are transported from the input zone 18 through a print zone to the output zone 24.

The charging effect is caused at least in part by a corona discharge around the bristle tips of the charging brush 32 where an intense electric field gradient causes ionization of the air with consequent current passing from the brush to the top surface of the belt 10. This is compounded by a triboelectric effect in which charge remains on the paper sheets 12 as contact between the sheets and the bristle tips are broken owing to movement of the belt 10 around the roller system. As indicated, opposite polarity negative charge is induced on the underside of the belt 10. The combination of positive charge at the top surfaces of the belt and paper sheets together with the negative charges at the reverse surface of the belt cause the paper sheets as they are launched onto the belt 10 to become electrostatically tacked to it.

As illustrated, each sheet 12 is charged as it is launched onto the belt 10. This is the preferred arrangement although, as between charging and launching, one could lag the other. In this circumstance, the neutralizing circuit 56 may be used to some extent to adjust the tacking force. However, there must be enough upstream tacking of the sheet 12 to the belt 10 to ensure initial registration. The tacking force depends on the relative positions of the charging brush 32 and the sheet 12. In all cases, there must be a ground plane directly underneath the charging brush 32, otherwise desired charging cannot be achieved.

As illustrated in FIG. 1, upstream of the charging station 22 and roller 40, grounded brushes 44 are placed with tips in contact with the inside and outside of the belt 10. The purpose of the brushes 44 is to discharge, to the extent possible, any residual charge at the surfaces of the belt 10 before the belt picks up launched sheets 12 and tracks through the charging circuit and a neutralizing circuit to be described presently. Typically, the charging circuit establishes a potential difference across the belt of about 500 V and a top surface voltage of about 1.5 kV. This means that there is a high electrical field at the top belt surface. This can have an adverse effect on ink ejection at the inkjet printhead 30.

Figure 3:
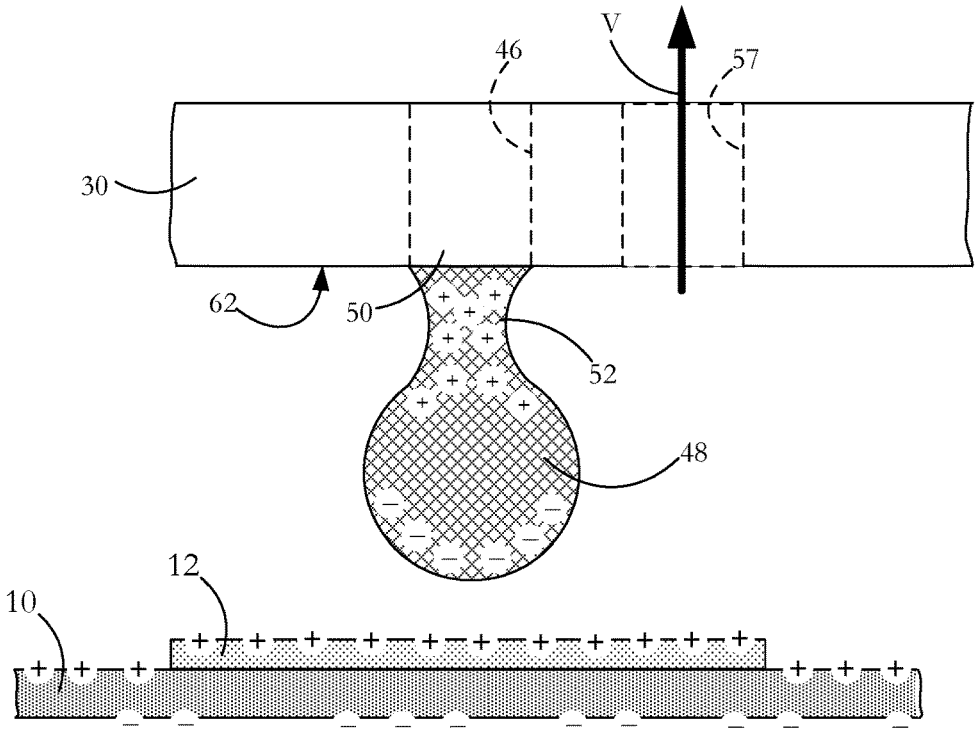
FIG. 3 is a scrap side sectional view of an inkjet printer ink droplet immediately before ejection thereof from a printer nozzle towards a paper sheet on a belt forming part of a paper sheet transport mechanism according to an embodiment of the invention.
Figure 4:
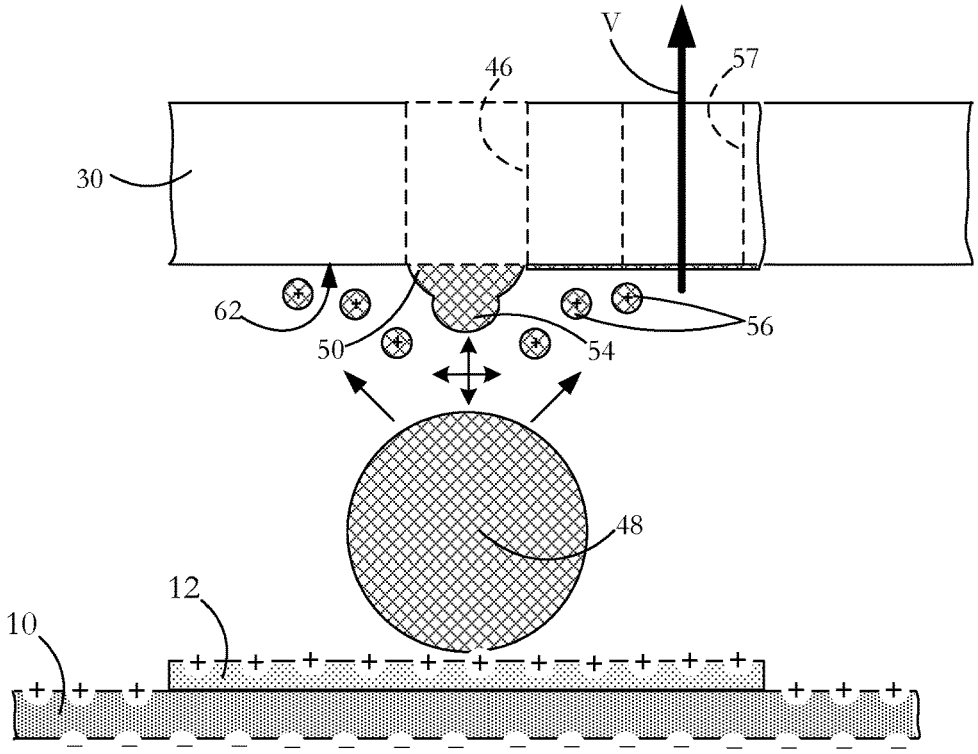
FIG. 4 is a scrap side sectional view corresponding to FIG. 3 but showing the ink droplet immediately after ejection from the printer nozzle.

An inkjet printer operates by ejecting droplets of ink onto a web or sheet medium. Such printers have print heads that are non-contact heads with ink being transferred during the printing process as minute "flying" ink droplets over a short distance of the order of ½ to 1 millimeter. Modern inkjet printers are generally of the continuous type or the drop-on-demand type. In the continuous type, ink is pumped along conduits from ink reservoirs to nozzles. The ink is subjected to vibration to break the ink stream into droplets, with the droplets being charged so that they can be controllably deflected in an applied electric field. In a thermal drop-on-demand type, a small volume of ink is subjected to rapid heating to form a vapour bubble which expels a corresponding droplet of ink. In piezoelectric drop-on-demand printers, a voltage is applied to change the shape of a piezoelectric material and so generate a pressure pulse in the ink and force a droplet from the nozzle. Of particular interest in the context of the present invention are thermal drop-on-demand inkjet print heads commercially available from Silverbrook Research. Such print heads are sold under the Memjet trade name and have a very high nozzle density, page wide array and of the order of five channels per print head. Such inkjet print heads have a very high resolution of the order of 1600 dots per inch. FIGS. 3 and 4 show part of a printhead 30 of a typical inkjet printer. The figures illustrate one of a high number of passages 46 extending through the printhead for delivering ink for ejection as droplets 48 from a nozzle 50 from where it will drop down onto paper sheet. FIG. 3 shows an ink droplet 48 immediately before it becomes detached from ink in the associated passage 46 while FIG. 4 shows the droplet 48 after it is detached and while it is descending towards the paper sheet 12 which is supported on the insulated belt 10. Also shown in FIGS. 3 and 4 is an indication of charge concentration and polarity. The effect of the charging circuit shown in FIG. 1 is to induce positive charges at the top surfaces of the belt 10 and paper sheet 12 and corresponding negative charges on the bottom of the belt. The average voltage at the top surface is about 1.5 kV resulting from the charging brush being held at a voltage of about 3.5 kV. As shown in FIG. 3, the positively charged paper sheet 12 and belt 10 induce a separation of charge in the emerging droplet 48 so that its lower surface part is negatively charged while positive charge collects at a separation zone 52 where the droplet 48 is destined to separate from the reservoir of ink in the passage 46. At the moment of separation, as shown in FIG. 4, a positively charged tail portion 54 experiences the full field effect of the positively charged upper surfaces of the belt 10 and paper 12. The charged tail portion 54 is consequently repelled with such force that it causes trailing parts of the tail portion 54 to disintegrate resulting in a fine ink mist 55 with the mist particles being repelled towards the grounded print head 30.

Although the printhead 30 used in this embodiment has a vacuum passage 57 which parallels the array of ink ejection nozzles, of which illustrated nozzle 50 is one, an applied vacuum V is not sufficient to draw away all of the ink mist before it is driven against the print bar which forms part of the print head. To reduce the extent to which the ink mist is generated, a neutralizing or charge balancing circuit 56 is situated downstream of the charging circuit 22 to balance positive and negative charge on the respective top and bottom belt surfaces and the transported paper sheets 12. By balancing charges, the electric field near the printheads is reduced which reduces or eliminates the ink mist. The elements of the neutralizing circuit are located about 4 inches downstream from the charging circuit 22. The neutralizing circuit is configured to enable control of the tacking force on the transported sheets.

The neutralizing circuit consists of a top ground brush 58, a bottom neutralizing brush 60 and a neutralizing supply voltage $V_C$. The tip of the top ground brush 58 is adjustable from 1 mm. to 5 mm. above the top surface of the belt to control the initial electric field produced by the charge brush 32 and supply $V_B$. This height is set to allow 1 kV to 1.5 kV at the top side of the belt. The ground brush 58 acts as a metering blade to allow a maximum amount of total surface charge on the belt regardless of the amount of charging from the supply $V_B$. Care is taken to maintain the same spacing between the electrode 58 and paper surface across the width of the belt 10 so as to maintain a consistent surface charge across the belt width. The bottom electrode 60 is positioned so that its tip contacts the bottom inside surface of the belt 10. A controller 73 is used to adjust the neutralizing supply voltage $V_C$ applied to electrode 60 to force the electric field down towards 0 V by evenly balancing opposite polarity charge concentration on the top of the belt (including charge on the transported sheets) and the bottom of the belt. This minimizes the electric field under the printheads and can increase the tacking force on the transported paper sheets. The controller also adjusts the voltage applied to the charging circuit 22.

As in the case of the charging electrode 32, each of the electrodes 58, 60 is configured as a brush having stainless steel bristles although other structures and configurations for the electrodes 32, 58, 60 are contemplated. In particular, the electrode 58 may be a grounded metal plate held at a specific height above the top of the transport belt and directly above and parallel to the neutralizing brush on the bottom side of the belt. Typically, the gap is of the order of 1 to 5 mm depending on the desired electric field effect.

Figure 5:
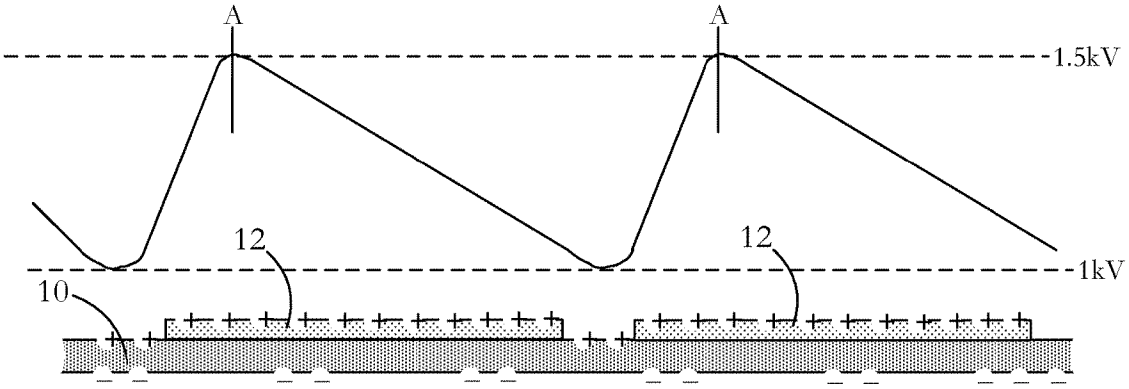
FIG. 5 is a graphic representation of variation of electric field adjacent a paper sheet being transported by an insulating belt where sheet and belt have been charged in a charging process forming part of a method according to an embodiment of the invention.
Figure 6:
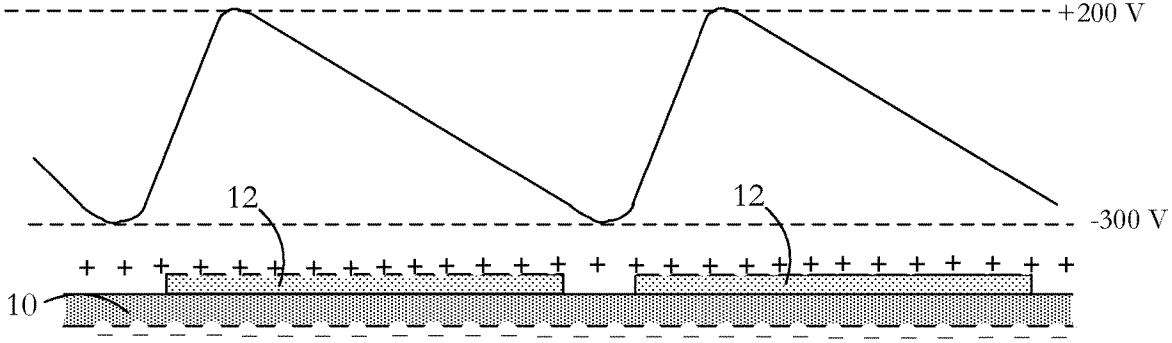
FIG. 6 is a graphic representation corresponding to FIG. 5, but showing such variation of electric field where the sheet and belt have been subjected to a neutralizing process forming part of a method according to an embodiment of the invention.

FIGS. 5 and 6 show variation in surface voltage of the belt 10 and transported paper sheets 12. FIG. 5 shows the situation without the neutralizing circuit operating and FIG. 6 shows the situation when the neutralizing circuit is operating.

In FIG. 5, the top surface voltage varies between a maximum of about 1.5 kV at positions A closer to the leading edges of the paper sheets than their trailing edges and a minimum of about 1 kV at gaps between successive paper sheets tacked to the transport belt. Consequently, the top surface of the belt and the paper sheets has an average voltage of about 1.2 kV, this giving rise to a high electric field near the printing face 62 of the printhead 30. FIG. 5 depicts the electric field near the belt and transported paper sheets resulting from the combined accumulated charge on the bottom and top sides of the belt and paper. Operation of the charging/tacking circuit leaves a charge imbalance resulting from a high accumulation of +ve charge on the belt top surface and a relatively smaller accumulation of −ve charge on the belt bottom surface. In the absence of transported paper sheets, a substantially steady state electric field exists adjacent the top surface of the belt. Paper is conductive with the level of conductivity changing with moisture content. Consequently, when a paper sheet moves under the charging brush 32, the +ve voltage at the top surface of the paper discharges somewhat through the paper surface to grounded surfaces of the paper alignment subsystem 20. In the FIG. 5 depiction, the discharge appears as a ramp downwards towards the trailing edge of the sheet. At the end of the sheet, there is a gap to the following sheet being transported on the belt. At the gap, the belt surface charge returns to the steady state until the next page passes through the charging station.

When the neutralizing circuit is operational as depicted in FIG. 6, by applying the neutralizing voltage $V_C$ on to the inside or lower surface of the belt, more negative charge is forced onto its surface. At the same time, the charging supply $V_B$ increases its current drive to compensate which, in turn, adds more +ve charge into the circuit, so increasing the tacking force. Once the neutralizing (charge balancing) voltage $V_C$ is adjusted to evenly balance −ve charge on the bottom of the belt and +ve charge to the top of the belt, then the electric field near the belt approaches zero. Thus, by adjusting the neutralizing voltage, the electric field present at the printheads can be substantially nullified. The tacking force on the paper sheet is controlled by adjusting both the charging supply $V_B$ and the neutralizing supply $V_C$ to move the electric field window into a minimal ink mist region. This is typically about +200 V (top) and −300 V (bottom) and, ideally, about 0 V (top) to −100 V (bottom), although these windows can change depending on belt materials, brush materials and the paper and moisture within the system. The belt top surface voltage varies between about 200 V at positions A and about −300 V at gaps G. Consequently, the top surface of the belt 10 and the paper sheets 12 has an average voltage close to zero and a low electric field near the printhead 30. The low electric field when the neutralizing circuit is operational means that, following ejection of an ink droplet 48, the associated ink tail 54 does not experience a strong repulsion from charge at the top surfaces of the belt and paper sheets. In turn, the risk of the ink mist being repelled towards the printheads when a droplet is ejected is much reduced. The printhead vacuum V is consequently much more effective which means that the print head stays cleaner and there is less chance of ink blemishes occurring during printing.

As indicated previously, through operation of the neutralizing circuit, the charging supply $V_B$ increases its current drive which adds more +ve charge into the circuit, so maintaining the tacking force. In fact, a subsidiary charging effect resulting from implementing the neutralization circuit acts to increase, the tacking force. Thus, increasing the negative charging of the outer side of the belt and attached sheet by supply $V_B$ sets up a voltage difference between the top side of the paper sheet and the top surface of the belt. Because charge does not fully leak across the paper, charge neutralization does not occur and consequently additional tacking force is contributed by the charge difference across the paper sheet. To measure tacking forces, a piece of adhesive tape was applied to a paper sheet tacked to the belt and a progressively increasing force was applied to the belt. The tacking force was taken to be that force at which the adhesion between the sheet and the belt was overcome so that the sheet was caused to slide laterally on the belt upper surface. A tacking force greater than 12 newtons was found necessary to avoid misregistration (skew) and/or lift of the paper sheet with a force of 20 newtons being generally satisfactory for operational purposes. Using the neutralizing process, a tacking force above 64 newtons could be achieved but, generally, such a high force tacking is not desirable as it is harder, once the printing process is complete, to strip the printed paper sheet from the belt.

As previously indicated the grounded electrode 58 can be moved up and down to alter the extent to which positive charge is removed from the paper sheets 12 transported past the electrode. In one embodiment, the electric field is measured by a sensor circuit having a sensor 64 located downstream of the neutralizing circuit. Thus, for example, because of humidity change, if the electric field adjacent the belt top surface increases, the electrode 58 is lowered to remove more charge from the transported sheets 12. Although charge adjustment is to the top surface of the belt 10 and paper sheets 12, it will be understood that the electric field to which the printhead is subject results from charges on both sides of the belt and the paper sheets. Optionally, an output sensor 75 is used at the output zone to detect whether a charge delta occurs after compensation applied by the neutralizing circuit. If the output surface charge is significantly changed from that detected at the sensor 64, it can be presumed that surface charging has occurred. This may have any of a number of causes such as (a) relaxation of charge due to natural discharge through the paper and belt, and/or ground frame proximity contact or (b) charge accumulation caused by inking from the upstream printheads. If the change is consistent, an appropriate adjustment can be made at the neutralizing circuit. The outputs from the sensors 64 and 75 are taken as inputs to the controller 73.

Other configurations for the neutralizing circuit are possible provided that their functional effect is similar. For example, it is not essential that the lower electrode 60 touches the bottom surface of the belt 10 provided that an air gap between the electrode 60 and the belt 10 is made sufficiently small. However, variations in the size or humidity of the air gap can cause fluctuations in the effect of the neutralizing electrode 60 which may be relatively difficult to correct and control given its position inside the belt 10. In contrast, the grounded electrode 58 is much more easily accessed for monitoring and resetting the width of the air gap between it and the top of the belt to compensate for humidity changes or inadvertent electrode movement.

In another configuration, all of the system polarities could be reversed so long as the reversal extends consistently throughout the system. In a further alternative embodiment, other highly insulating materials may be used as an alternative to Mylar® in the belt construction.

Other elements of the illustrated system of FIGS. 1 and 2 will now be described for completeness. The paper alignment sub-system 20 is used for initially aligning sheets 12 entering the input zone 18 to a datum and can take any of a number of known forms. The arrangement shown in FIG. 2 has a series of alignment rollers 66 having non-smooth bearing surfaces, the alignment rollers mounted at an angle to the sheet feed direction and a fence 36 aligned with the feed direction. Rectangular paper sheets are transferred into the alignment sub-system 20 generally in an orientation in which they are to pass through the print zones. The inclined rollers 66 are rotated so that a frictional contact between the surfaces of the rollers and the sheets drives the sheets against the fence 68 to more accurately align the sheets with the feed direction. While still under the control of the alignment sub-system, leading parts of the sheets pass under the brush 32 and are electrostatically tacked in the then-current position. Other types of feed mechanism for launching sheet media onto the belt 10 may alternatively be used such as a conventional notched wheel driver, the notched wheel having fingers orientated and stiff enough to drive sheets against an alignment edge but sufficiently flexible not to scuff or otherwise damage the sheet media. It will be appreciated that other methods for alignment of sheet media can be used.

The paper alignment sub-system is supplemented by a tracking sub-system which tracks the movement of sheets through the print zone. To ensure accurate positioning of the image on the sheets in the transport direction, the leading edge of each sheet is first detected before the sheet reaches the first print engine 28 in the print engine array. Following this first detection, only the motion of the belt 10, as accurately measured by a shaft encoder 70 mounted on the belt drive, is used for tracking. Because each sheet 12 is electrostatically tacked to the belt 10, accurate tracking of the sheets is ensured. Tracking signals from the shaft encoder 70 form inputs to a control module 72, the control module also having an input I comprising image data for images or partial images to be printed by each of the print engines 28. The control module 72 has outputs (one of which is shown) to each of the print heads 30 which instructs which nozzles of each print head are to be fired and the instant at which each such nozzle is to be fired. The instant of firing of each nozzle is made to depend on the tracking data for that nozzle so that partial images from successive print heads which are to be combined as a single image are in precise registration.

In relation to transverse control, any excursion of the belt 10 in a transverse direction as it is driven through the print zone is monitored by an optical sensor and, based on the sensor output, the idler roller is adjusted to maintain the transverse position of the belt constant to within an acceptably small tolerance. Note that even if accurate initial alignment of sheets is not completely achieved at the sub-system resulting in the sheet having a transverse offset or skew, because the sheet is tacked to the belt, any such offset or skew is unchanged as the sheet is presented to each print engine 28 as it is transported through the print zone. Consequently, downstream component images can be deliberately subjected to the same offset or skew as they are printed by successive print heads 28, resulting in an accurately registered combination image.

At the output zone, partial stripping of paper sheets from the belt is achieved by using the inherent stiffness of the sheet paper to cause a leading edge portion of a sheet to spring away from the belt as the belt turns at the drive roller 14. Subsequent full stripping of the sheet is achieved by the presence of a stripper bar 74 mounted so that the initially lifted sheet edge portion passes over the top of the bar as the belt passes underneath the bar.

With the invention described, paper sheets are firmly tacked to the belt and so can be accurately transported under the array of inkjet print heads. The multiple print head system can be operated at a very fast sheet processing rate of the order of 700 mm/second or more. Even though multiple overprinted or combined images with highly accurate registration can be achieved using this method, ink deposited on a sheet upper surface is not disturbed as the sheet is transported through successive print zones at the array of print heads.

Generally, accurate transport of sheet media is rendered more difficult if the transport system has to handle papers with a wide range of properties. In terms of surface finish, a sheet may be smooth or rough, and shiny or matt. In terms of thickness and density, the paper may range from tissue paper to card stock. The controllability and accuracy of conventional sheet transport systems, including those described previously may vary with variation in any or all of these particular sheet paper properties. The apparatus and method described herein can be used effectively with papers and other sheet media having a range of properties, including surface finish, thickness and density.

By electrostatically tacking the paper to the belt, a simplified tracking system can be used which tracks the position and motion of the belt instead of the position and motion of the paper sheets. The belt material is more stable and stiffer than paper. Consequently, it is easier to obtain accurate registration and other handling dynamics over a wider range of papers regardless of paper surface finish, thickness and density.

In an alternative embodiment of the invention, an AC source is used to charge the belt upper surface and tack media sheets to the belt. In this embodiment, the frequency and amplitude of the charging voltage are selected to optimize (a) desired tacking force and (b) minimum mean detected voltage under the printheads. In one example, an AC source having a peak to peak voltage of +2.5 kV to −2.5 V and a frequency of 200 Hz was used. The size of charge areas is set by the source frequency and transport speed of the paper sheets. A higher frequency is preferred for reducing electric field at the printhead. The paper sheet is tacked to the belt regardless of whether the top surface is positively or negatively charged. Because a highly insulating material is used for the belt construction, charges at the boundaries between charged regions of different polarity do not annihilate one another. There may be some charge annihilation at zone boundaries owing to high humidity conditions but such a situation can be alleviated by ensuring the printer is operated in a low humidity environment. As in the case of the DC charging methods described previously, a voltage in the range 2 kV to 3.5 kV was used. In both cases, a source voltage greater than 3.5 kV can be used so long as the structure and process are configured to prevent discharge from highly charged areas of the belt and paper sheets to components of the equipment that are grounded or at very different voltage. The AC tacking can be used in combination with a neutralizing circuit as described previously to minimize the electric field at the printheads. In such a combination, the neutralizing circuitry is used to reduce or eliminate any DC offset introduced by the transported media sheets.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. A media sheet drive comprising a continuous belt of a dielectric material for transporting sheet media supported on the belt in a transport direction, a launch mechanism to launch a sheet medium onto a top surface of the belt, a charging circuit including a charging head for charging a top surface of the sheet medium as the sheet medium is launched, thereby to generate a tacking force to tack the sheet medium to the belt, and a neutralizing circuit downstream of the charging circuit for generally balancing charge as between the top surface of the sheet medium and the bottom surface of the belt to reduce electric field near said top surface while keeping the sheet medium tacked to the belt, the neutralizing circuit including a first electrode adjacent the top surface of the belt to reduce charge of a first polarity at the top surface of the belt and the sheet medium, the first electrode having a tip thereof separated from said one surface by an air gap.

2. A media sheet drive as claimed in claim 1, the charging circuit including a charging head positioned to bear against the top surface of the belt and the sheet medium as the sheet medium is launched onto the belt.

3. A media sheet drive as claimed in claim 1, the neutralizing circuit including a second electrode contacting the bottom surface of the belt for increasing charge of a second polarity opposite to the first polarity onto the bottom surface.

4. A media sheet drive as claimed in claim 1, further including a sensor to sense electric field near the top surface of the belt.

5. A media sheet drive as claimed in claim 4, the sensor being part of a feedback circuit, the feedback circuit having a first output for controlling operation of the neutralizing circuit.

6. A media sheet drive as claimed in claim 4, the sensor being part of a feedback circuit, the feedback circuit having a second output for controlling operation of the charging circuit.

7. A media sheet drive as claimed in claim 1, wherein the charging circuit includes a DC charging source.

8. A media sheet drive as claimed in claim 1, wherein the charging circuit includes an AC charging source.

9. A media sheet drive comprising a continuous belt of a dielectric material for transporting sheet media supported on the belt in a transport direction, a launch mechanism to launch a sheet medium onto a top surface of the belt, a charging circuit including a charging head for charging a top surface of the sheet medium as the sheet medium is launched, thereby to generate a tacking force to tack the sheet medium to the belt, and a neutralizing circuit downstream of the charging circuit for balancing charge as between the top surface of the sheet medium and the bottom surface of the belt to reduce electric field near said top surface while maintaining the tacking force between the sheet medium and the belt, and a tracking sub-system for tracking movement of the belt, and a control module to coordinate operation of the print heads with the tracked movement of the belt whereby to obtain a combined image comprising a first partial image printed by a first print head in registration with a second partial image printed by a second print head.

* * * * *